United States Patent [19]

Barclay et al.

[11] 4,256,548

[45] Mar. 17, 1981

[54] ELIMINATION OF ANODE HYDROGEN CYANIDE FORMATION IN TRIVALENT CHROMIUM PLATING

[75] Inventors: Donald J. Barclay; James M. L. Vigar, both of Winchester, England

[73] Assignee: International Business Machines Corporation, Armonk, N.Y.

[21] Appl. No.: 86,091

[22] Filed: Oct. 18, 1979

[30] Foreign Application Priority Data

Nov. 11, 1978 [GB] United Kingdom ..... 44178/78

[51] Int. Cl.[3] ..... C25D 3/06; C25D 3/56

[52] U.S. Cl. ..... 204/43 R; 204/51

[58] Field of Search ..... 204/51, 43 R

[56] References Cited

U.S. PATENT DOCUMENTS

| | | | |
|---|---|---|---|
| 4,062,737 | 12/1977 | Barclay et al. | 204/43 R |
| 4,141,803 | 2/1979 | Barclay et al. | 204/51 |
| 4,161,432 | 7/1979 | Barclay et al. | 204/51 |

*Primary Examiner*—G. L. Kaplan

*Attorney, Agent, or Firm*—Francis A. Sirr

[57] ABSTRACT

Generation of hydrogen cyanide at the anode in a chromium (III) - thiocyanate plating bath, resulting from oxidation of thiocyanate anions, is prevented by an additive to the electroplating solution which oxidizes at the anode in preference to the thiocyanate, and whose reaction products will not adversely affect the cathode reaction. Such an additive is potassium iodide.

17 Claims, No Drawings

ELIMINATION OF ANODE HYDROGEN CYANIDE FORMATION IN TRIVALENT CHROMIUM PLATING

FIELD OF THE INVENTION

This invention relates to chromium or chromium alloy electroplating solutions and processes in which the source of chromium comprises an aqueous solution of a chromium (III)-thiocyanate complex.

BACKGROUND ART

Conventionally chromium has been plated from aqueous chromic acid baths prepared from chromic oxide ($CrO_3$) and sulphuric acid. Such baths, in which the chromium is in hexavalent form, are characterized by low current efficiency. The chromic acid fumes emitted as a result of hydrogen evolution also present a health hazard. In order to overcome the undesirable aspects of hexavalent chromium plating, it has been proposed to plate chromium in trivalent form. One such process for plating chromium or a chromium alloy from an aqueous solution of a chromium (III)- thiocyanate complex is described in UK Pat. No. 1,431,639 and U.S. Pat. No. 4,062,737.

U.S. Pat. No. 4,161,432 describes a chromium or chromium alloy plating solution and process in which an aqueous solution of a chromium (III) thiocyanate complex is again employed but in which a buffer material supplies one of the ligands to the chromium complex. The buffer material is selected from amino acids (eg glycine), peptides, formates, acetates and hypophosphites.

Our UK Patent Application No. 13458/78 discloses a technique for avoiding deleterious anode reactions in electroplating baths by providing a perfluorinated cation exchange membrane to separate an anolyte from a catholyte. The effect on the required plating voltage of the electrical resistance of the membrane may be reduced by addition of a depolarising species to the anolyte. In one example a catholyte containing an aqueous solution of a chromium (III)-thiocyanate complex including glycine is separated by a membrane from an anolyte comprising an Agar gel saturated with a solution of 2 M potassium iodide in 0.1 M sulphuric acid. The potassium iodide is a depolarising agent and provides iodide ions ($I^-$) which are oxidized to iodine at the anode.

SUMMARY OF THE INVENTION

It has been discovered that thiocyanate based chromium plating baths of the kind described in aforementioned U.S. Pat. Nos. 4,062,737 and 4,161,432 evolve hydrogen cyanide during the plating process. Under certain conditions the amounts of hydrogen cyanide generated at the anode can result in concentrations >100 ppm, as measured 1 cm above the surface and adjacent to the anode, although at the cathode the maximum concentration does not exceed 2 ppm. The amount generated at the anode is unacceptable from a health and safety point of view.

It is believed that the probable sequence of reactions leading to generation of hydrogen cyanide is as follows:

(i) $2\ NCS^- - 2e \rightarrow (NCS)_2$ which is an electrochemical oxidation reaction at the anode;

(ii) $2\ CL^- - 2e \rightarrow Cl_2$ which is also an electrochemical oxidation reaction at the anode;

(iii) $Cl_2 + 2\ NCS^- \rightarrow (NCS)_2 + 2\ Cl^-$ which is a chemical redox reaction:

(iv) $4H_2O + 3(NCS)_2 \rightarrow 5NCS^- + SO_4^{2-} + CN^- + 8H^+$ which is a hydrolysis reaction resulting in the production of free cyanide ($CN^-$) which in the acidic operating conditions of such baths forms the volatile hydrogen cyanide.

Reactions (ii) and (iii) occur when, as is commonly the case, sodium chloride is present in the bath as a conductivity salt. These reactions increase the amount of free thiocyanogen produced and thus accentuate the problem. However, it should be realized that hydrogen cyanide will be formed through the mechanism of reactions (i) and (iv) alone.

One way of preventing hydrogen cyanide evolution is to employ a membrane and a separate anolyte and catholyte, primarily for the prevention of chlorine evolution, as described in our UK Patent Application No. 13458/78. However, it is also desirable to solve the problem without requiring the use of a membrane.

Accordingly, the present invention provides a chromium or chromium alloy electroplating solution in which the source of chromium comprises an aqueous solution of a chromium (III)-thiocyanate complex and which is susceptible to evolution of hydrogen cyanide as a result of the oxidation of thiocyanate anions to free thiocyanogen at the anode characterized in that the solution further comprises an additive which will undergo oxidation at the anode in preference to the thiocyanate oxidation.

Preferably, the additive is an iodide, specifically potassium iodide.

The invention also provides a process of plating chromium or a chromium alloy comprising passing an electric current between an anode and a cathode both of which are immersed in such an electroplating solution, in which process chromium or chromium alloy is deposited on the cathode and the additive is electrochemically oxidized at the anode in preference to the oxidation of thiocyanate anions.

A preferred additional step in such a process is the step of chemically reducing the additive oxidation products back to the original additive.

Where the additive is potassium iodine such chemical reduction is preferably achieved by adding hydrazine or a source of sulphite to the solution.

DETAILED DESCRIPTION

The present invention lies in the realization that the generation of hydrogen cyanide in a thiocyanate chromium plating bath results essentially from the oxidation of thiocyanate ions, $NCS^-$, to free thiocyanogen $(NCS)_2$ at the anode and that this can be prevented by means of an alternative anode reaction which takes place at a lower potential. The thiocyanate oxidation process has a reversible potential Eo of 0.77 volts with respect to hydrogen.

Not all anode reactions having a lower reversible potential will prevent thiocyanate oxidation. Some have been found to be ineffective because the reaction rate at the reversible potential is too slow and the actual oxidation potential needed to achieve a reasonable reaction rate is above that needed for thiocyanate oxidation. Other anode reactions are found to affect the reduction (plating) process adversely. For example, a ferrous to ferric oxidation was tried but interfered with the plating reaction as iron was deposited on the cathode.

It has been found that an addition of iodide ions in the form of potassium iodide to a chromium (III)-thiocyanate electroplating solution introduces an anode oxidation reaction to which the plating process is tolerant. Iodide ions are oxidized to free iodine according to the following reaction:

$$2I^- - 2e \rightarrow I_2$$

This reaction was a reversible anode potential of 0.53 volts with respect to hydrogen. Since it is an electrochemically fast reaction, its actual oxidation potential is close to this value and thus prevents thiocyanate oxidation.

Furthermore, the iodine can be chemically reduced back to iodide ions thus regenerating the solution and preventing the accumulation of free iodine in the bath. Both hydrazine and a source of sulphite ions will chemically reduce iodine to iodide. Such a chemical reduction is necessary because, although tolerant of iodine, the chromium plating reaction would ultimately be affected by reduction of iodine back to iodide at the cathode.

The hydrazine reaction is as follows:

$$N_2H_4 + 2I_2 \rightarrow N_2 + 4I^- + 4H^+$$

Although this has been carried out successfully, the rate is marginally slow and is pH sensitive in the pH range of the plating bath. In addition, the plating process can be adversely affected by excess hydrazine, probably because of the formation of ammonium ions, and thus the amount added has to be accurately gauged to correspond to the amount of iodine generated.

The sulphite reaction is as follows:

$$H_2SO_3 + I_2 + H_2O \rightarrow H_2SO_4 + 2H^+ + 2I^-$$

This reaction proceeds fairly rapidly and the chromium plating reaction is more tolerant of excess sulphite than is the case with hydrazine. The sulphate ions which are a product of this reaction accumulate in the bath but can be removed as an insoluble precipitate of barium sulphate by treating the bath with either barium hydroxide, barium chloride or barium carbonate.

An alternative to a source of iodide ions as the additive in a source of ferrocyanide ions. The oxidation of ferrocyanide to ferricyanide according to the reaction $$Fe(CN)_6^{4-} - e \rightarrow Fe(CN)_6^{3-}$$

will take place at a sufficiently low potential to prevent thiocyanate oxidation. As with the iodine reaction, the ferricyanide can be chemically reduced back to ferrocyanide by the addition of hydrazine or a sulphite.

Instead of an additive whose oxidation is chemically reversible an additive such as hydrazine can be used which undergoes an irreversible reaction but whose reaction products are totally harmless. In the case of hydrazine the following reaction occurs:

$$NH_2.NH_2 - 4e \rightarrow N_2 + 4H^+$$

The reaction product nitrogen is gaseous and thus escapes from the solution without building up to affect the cathode reaction. Failure of hydrazine to affect the hydrogen cyanide evolution in some circumstances may be overcome by pH adjustment and choice of a suitable anode.

In general, an additive will prevent hydrogen cyanide evolution if its actual oxidation potential at the anode is less than that of thiocyanate. For commercial applications the oxidation products should not be deleterious to the chromium reduction process or else should be chemically reducible, in a non-deleterious manner, back to the original form.

The invention will now be described with reference to the following specific examples:

EXAMPLE 1

A chromium (III)-thiocyanate electroplating solution was made up as follows:

(a) 240 grams of boric acid ($H_3BO_3$) were added to approximately 3 liters of water, which was then heated and stirred to dissolve the boric acid.

(b) 132.5 grams of chromium sulphate ($Cr_2(SO4)_3.15H_2O$) were added to this solution which was then heated and stirred to dissolve the chromium sulphate.

(c) 64.85 grams of sodium thiocyanate (NaNCS) were added to the solution which was then heated and stirred at a temperature above 70° C. for approximately one hour.

(d) 40 grams of glycine ($NH_2.CH_2.COOH$) were added to the solution which was then heated and stirred at a temperature above 70° C. for approximately one hour.

(e) 467.5 grams of sodium chloride (NaCl) were added to the solution which was then heated and stirred to dissolve the sodium chloride.

(f) Approximately 0.4 grams of a wetting agent known as FC 98 (product of 3M Corporation) was added to the solution.

(g) The solution pH was adjusted from approximately pH 1.6 to pH 2.5 with 10% sodium hydroxide solution.

(h) The solution was made up to 4 liters with distilled water and adjusted to pH 2.5 with 10% hydrochloric acid.

The solution thus prepared had essentially the following composition:

| | |
|---|---|
| 0.1M | Cr(III) |
| 10g/l | glycine |
| 0.2M | NaNCS |
| 60g/l | boric acid |
| 2M | NaCl |

The boric acid functions as a pH buffer and the sodium chloride imparts conductivity to the electrolyte. The glycine is a buffer material which supplies one of the ligands to the chromium complex.

Potassium iodide was added to this solution and allowed to dissolve therein. The concentration of potassium iodide was 0.4 M.

This solution was introduced into a Hull cell and test pieces were plated at a current of 10 Amps. The cathode current density was 150 mA/cm$^2$ and the anode current density was 50 mA/cm$^2$. Good plating of chromium onto the cathode resulted, with good coverage. No hydrogen cyanide was generated at the anode but iodine was generated in the solution.

After one ampere hour of plating tests, a chemical equivalent of hydrazine was added to the solution. The iodine in the solution was reduced.

EXAMPLE II

Plating was carried out exactly as for Example I except that, after one ampere hour of plating, sodium sulphite was introduced to the solution. The iodine in the solution was reduced. The addition of excess sodium sulphite did not affect plating quality.

While we have described preferred embodiments of our invention, it is to be understood that we do not limit ourselves to these precise disclosures and the right is reserved to all changes and modifications coming within the scope of the invention as defined in the appended claims.

What is claimed is:

1. A chromium or chromium alloy electroplating solution in which the source of chromium comprises an aqueous solution of a chromium (III)-thiocyanate complex and which is susceptible to evolution of hydrogen cyanide as a result of the oxidation of thiocyanate anions to free thiocyanogen at the anode characterized in that the solution further comprises an additive which will undergo electrochemically reversible oxidation at the anode in preference to the thiocyanate oxidation.

2. An electroplating solution as claimed in claim 1 in which the additive is a source of iodide ions.

3. An electroplating solution as claimed in claim 2 in which the source of iodide ions is potassium iodide.

4. An electroplating solution as claimed in claim 1 in which the additive is a source of ferrocyanide ions.

5. An electroplating solution as claimed in claim 1 in which the additive's oxidation potential at the anode is less than that of thiocyanate.

6. An electroplating solution as claimed in claim 5 in which the additive is a source of iodide ions.

7. A chromium or chromium alloy electroplating solution in which the source of chromium comprises an aqueous solution of chromium sulphate ($Cr_2(SO4)_3.15H_2O$) and sodium thiocyanate (Na NCS), and which is susceptible to evolution of hydrogen cyanide as a result of the oxidation of thiocyanate anions to free thiocyanogen, characterized in that the solution comprises an iodide ion additive which will undergo oxidation at the anode in preference to thiocyanate oxidation, and further comprise a pH buffer, a constituent to impart conductivity to the solution, and a further buffer which supplies one of the ligands to the chromium complex.

8. An electroplating solution as claimed in claim 7 in which said pH buffer is boric acid ($H_3BO_3$), said constituent is sodium chloride (NaCl), and said further buffer is glycine ($NH_2.CH_2.COOH$).

9. A process of plating chromium or a chromium alloy comprising passing an electric current between an anode and a cathode both of which are immersed in an electroplating solution in which the source of chromium comprises an aqueous solution of a chromium (III)-thiocyanate complex, in which process chromium or a chromium alloy is deposited on the cathode and an additive is provided which is electrochemically oxidized at the anode in preference to the oxidation of thiocyanate anions and is a source of iodide ions.

10. A process as claimed in claim 9 further comprising the step of chemically reducing the additive oxidation products back to the original additive.

11. A process as claimed in claim 10 in which the step of chemically reducing the additive oxidation products comprises adding hydrazine to the solution.

12. A process as claimed in claim 11 in which the additive is potassium iodide.

13. A process as claimed in claim 10 in which the step of chemically reducing the additive oxidation products comprises adding a source of sulphite to the solution.

14. A process as claimed in claim 13 comprising the further step of precipitating sulphate ions formed as a result of the chemical reduction step out of solution by adding barium hydroxide, barium chloride or barium carbonate to the solution.

15. A process as claimed in claim 14 in which the additive is potassium iodide.

16. A chromium or chromium alloy electroplating solution in which the source of chromium comprises an aqueous solution of chromium sulphate ($CR_2(SO4)_3.15H_2O$) and sodium thiocyanate (Na NCS) which is susceptible to evolution of hydrogen cyanide as a result of the oxidation of thiocyanate anions to free thiocyanogen at the anode, characterized in that the solution further comprises a potassium iodide additive which undergoes oxidation at the anode in preference to thiocyanate oxidation.

17. An electroplating solution as claimed in claim 16 including boric acid ($H_3BO_3$) functioning as a pH buffer, sodium chloride (NaCl) importing conductivity to the solution, and a glycine ($NH_2.CH_2.COOH$) buffer supplying one of the ligands of the chromium complex.

* * * * *